US010458003B2

(12) United States Patent
Maki et al.

(10) Patent No.: US 10,458,003 B2
(45) **Date of Patent: *Oct. 29, 2019**

(54) COPPER ALLOY AND COPPER ALLOY FORMING MATERIAL

(71) Applicant: MITSUBISHI MATERIALS CORPORATION, Tokyo (JP)

(72) Inventors: Kazunari Maki, Saitama (JP); Yuki Ito, Okegawa (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/353,924

(22) PCT Filed: Nov. 6, 2012

(86) PCT No.: PCT/JP2012/078688

§ 371 (c)(1),
(2) Date: Apr. 24, 2014

(87) PCT Pub. No.: WO2013/073412

PCT Pub. Date: May 23, 2013

(65) Prior Publication Data

US 2014/0290805 A1 Oct. 2, 2014

(30) Foreign Application Priority Data

Nov. 14, 2011 (JP) ..... 2011-248731

(51) Int. Cl.
*C22C 9/05* (2006.01)
*C22F 1/00* (2006.01)
(Continued)

(52) U.S. Cl.
CPC ..... *C22C 9/05* (2013.01); *C22C 9/00* (2013.01); *C22F 1/00* (2013.01); *C22F 1/08* (2013.01); *C22C 1/03* (2013.01)

(58) Field of Classification Search
CPC ..... C01P 2002/60; C22F 1/00; C22F 1/002; C22F 1/08; H01B 1/026
See application file for complete search history.

(56) References Cited

U.S. PATENT DOCUMENTS 2,164,065 A 6/1939 Hensel et al.
4,337,793 A 7/1982 Sato et al.
(Continued)

FOREIGN PATENT DOCUMENTS

CN 1225949 A 8/1999
CN 1233856 A 11/1999
(Continued)

OTHER PUBLICATIONS

JP 11-199954, computer-generated translation, Japanese-language version published on Jul. 27, 1999.*
(Continued)

*Primary Examiner* — Vanessa T. Luk
(74) *Attorney, Agent, or Firm* — Leason Ellis LLP

(57) ABSTRACT

Copper alloys according to first to third aspects contain Mg at a content of 3.3% by atom to 6.9% by atom, with the balance substantially being Cu and unavoidable impurities, wherein an oxygen content is in a range of 500 ppm by atom or less, and either one or both of the following conditions (a) and (b) are satisfied: (a) when a Mg content is set to X % by atom, an electrical conductivity σ (% IACS) satisfies the following Expression (1), $$\sigma \leq \{1.7241/(-0.0347 \times X^2 + 0.6569 \times X + 1.7)\} \times 100 \quad (1);$$

and (b) an average number of intermetallic compounds, which have grain sizes of 0.1 μm or more and contain Cu and Mg as main components, is in a range of 1 piece/μm$^2$ or less. A copper alloy according to a fourth aspect further contains one or more selected from a group consisting of Al, Ni, Si,
(Continued)

Mn, Li, Ti, Fe, Co, Cr, and Zr at a total content of 0.01% by atom to 3.0% by atom, and satisfies the condition (b).

21 Claims, 3 Drawing Sheets

(51) Int. Cl.

| | |
|---|---|
| ***C22F 1/08*** | (2006.01) |
| ***C22C 9/00*** | (2006.01) |
| *C22C 1/03* | (2006.01) |

(56) References Cited

U.S. PATENT DOCUMENTS

| | | | | |
|---|---|---|---|---|
| 4,715,910 | A | 12/1987 | Mandigo et al. | |
| 4,732,731 | A | 3/1988 | Asai et al. | |
| 5,667,752 | A | 9/1997 | Suzuki et al. | |
| 7,041,252 | B2 | 5/2006 | Szakalos | |
| 2006/0239853 | A1* | 10/2006 | Maehara | B22D 21/025 420/492 |
| 2006/0275618 | A1 | 12/2006 | Kugimiya et al. | |
| 2007/0056661 | A1 | 3/2007 | Ota et al. | |
| 2008/0298998 | A1 | 12/2008 | Kaneko | |
| 2010/0086435 | A1 | 4/2010 | Era | |
| 2010/0326573 | A1 | 12/2010 | Mihara et al. | |
| 2011/0281134 | A1 | 11/2011 | Maki et al. | |
| 2012/0267013 | A1* | 10/2012 | Kaneko | C22C 9/06 148/554 |
| 2013/0048162 | A1 | 2/2013 | Ito | |
| 2013/0284327 | A1 | 10/2013 | Maki et al. | |
| 2014/0283961 | A1 | 9/2014 | Maki | |
| 2014/0283962 | A1 | 9/2014 | Ito | |
| 2014/0290805 | A1 | 10/2014 | Maki | |
| 2016/0160321 | A1 | 6/2016 | Ito | |

FOREIGN PATENT DOCUMENTS

| | | | | | |
|---|---|---|---|---|---|
| CN | 1948529 | A | | 4/2007 | |
| CN | 101001965 | A | | 7/2007 | |
| CN | 101487091 | A | | 7/2009 | |
| CN | 101707084 | A | | 5/2010 | |
| CN | 101724759 | A | | 6/2010 | |
| CN | 102206766 | A | | 10/2011 | |
| CN | 102822363 | A | | 12/2012 | |
| CN | 103842551 | A | | 6/2014 | |
| DE | 3628783 | A | | 10/1987 | |
| EP | 2319947 | A | | 5/2011 | |
| GB | 2065166 | A | | 6/1981 | |
| JP | 130072 | B | | 1/1939 | |
| JP | 53-125222 | A | | 11/1978 | |
| JP | 62-227051 | A | | 10/1987 | |
| JP | 62-250136 | A | | 10/1987 | |
| JP | 63-310929 | A | | 12/1988 | |
| JP | 64-052034 | A | | 2/1989 | |
| JP | 01-107943 | A | | 4/1989 | |
| JP | 01-309219 | A | | 12/1989 | |
| JP | 02-111834 | A | | 4/1990 | |
| JP | 02-145737 | A | | 6/1990 | |
| JP | 03-080858 | B | | 12/1991 | |
| JP | 04-268033 | A | | 9/1992 | |
| JP | 05-009619 | A | | 1/1993 | |
| JP | 05-082203 | A | | 4/1993 | |
| JP | 07-018354 | A | | 1/1995 | |
| JP | 07-019788 | A | | 1/1995 | |
| JP | 07-166271 | A | | 6/1995 | |
| JP | 10-219372 | A | | 8/1998 | |
| JP | 11-036055 | A | | 2/1999 | |
| JP | 11-186273 | A | | 7/1999 | |
| JP | 11-199954 | A | | 7/1999 | |
| JP | 2001-152303 | A | | 6/2001 | |
| JP | 2011-241412 | A | | 12/2001 | |
| JP | 2002-180165 | A | | 6/2002 | |
| JP | 2004-225060 | A | | 8/2004 | |
| JP | 2005-113259 | | * | 4/2005 | C22C 9/00 |
| JP | 2009-228013 | A | | 10/2009 | |
| JP | 2009-242814 | A | | 10/2009 | |
| JP | 2010-053445 | A | | 3/2010 | |
| JP | 4516154 | B | | 8/2010 | |
| JP | 2010-188362 | A | | 9/2010 | |
| JP | 2011-102416 | A | | 5/2011 | |
| JP | 2012-251226 | A | | 12/2012 | |
| JP | 2013-100571 | A | | 5/2013 | |
| JP | 2013-104095 | A | | 5/2013 | |
| KR | 10-2014-0048335 | A | | 4/2014 | |
| WO | WO-2006/000307 | A | | 1/2006 | |
| WO | WO-2009/096546 | A | | 8/2009 | |
| WO | WO-2010/013497 | A | | 2/2010 | |
| WO | WO-2011068135 | A1 | * | 6/2011 | C22C 9/06 |
| WO | WO-2011/104982 | A | | 9/2011 | |
| WO | WO-2011/142450 | A | | 11/2011 | |

OTHER PUBLICATIONS

Koya Nomura, "Technical Trends in High Performance Copper Alloy Strip for Connector and Kobe Steel's Development Strategy", *Kobe steel Engineering Reports*, 2004,vol. 54. No. 1, pp. 2-8.

Shigenori Hori et al., "Grain Boundary Precipitation in Cu-Mg alloy", *Journal of the Japan Copper and Brass Research Association*, 1980, vol. 19, pp. 115-124.

International Search Report and Written Opinion dated Feb. 12, 2013 for the corresponding PCT Application No. PCT/JP2012/078688.

International Search Report dated Aug. 16, 2011 for the related PCT Application No. PCT/JP2011/061036.

International Search Report dated Jan. 29, 2013 for the related PCT Application No. PCT/JP2012/077736.

International Search Report dated Feb. 12, 2013 for the related PCT Application No. PCT/JP2012/078851.

Office Action dated Feb. 14, 2012 for the related Japanese Application No. 2010-112265.

Office Action dated Nov. 29, 2013 for the related Singaporean Application No. 201207897-8.

Office Action dated Dec. 4, 2013 for the related Chinese Application No. 201180018491.7.

European Search Report dated Jun. 6, 2014 for the related European Application No. 11780706.5.

Office Action of the related U.S. Appl. No. 14/349,937 dated Jan. 12, 2015.

International Search Report dated Aug. 28, 2012 for the related PCT Application No. PCT/JP2012/063933.

ASM International Handbook Committee. (1990). ASM Handbook, vol. 02—Properties and Selection: Nonferrous Alloys and Special-Purpose Materials—9. Introduction to Copper and Copper Alloys. ASM International. Online version available at: http://app.knovel.com/hotlink/pdf/id:kt007OVW5L/asm-handbook-volume-02/introduction-copper-copper, pp. 216-233.

Ampcoloy 90—Corrosion-Resistant High-Conductivity Casting Copper, *Alloy Digest*, Mar. 1981.

Office Action dated Sep. 24, 2014 for the related U.S. Appl. No. 14/349,937.

Office Action dated Oct. 8, 2014 for the related U.S. Appl. No. 14/352,184.

Office Action dated Aug. 18, 2015 for the corresponding Japanese Application No. 2011-248731.

Notice of Allowance dated Aug. 31, 2015 for the related Taiwanese Application No. 101119749 (English translation of Search Report attached).

Office Action dated Nov. 16, 2015 for the related U.S. Appl. No. 13/697,441.

Office Action dated Jan. 14, 2016 for the related Taiwanese Patent Application No. 101139714.

Office Action dated Jan. 14, 2016 for the related Taiwanese Patent Application No. 101141343.

Notice of Allowance dated Jan. 27, 2015 for the related Japanese application No. 2011-126510.

Murray et al., "Preparation and Characterization of Pure Metals, Properties and Selection: Nonferrous Alloys and Special-Purpose

(56) References Cited

OTHER PUBLICATIONS

Materials", *ASM Handbook*, vol. 2, 1990, pp. 1093-1097(print), 13 pages in total (online), ASM International.
International Search Report dated Aug. 9, 2011 for the related PCT Application No. PCT/JP2011/060962.
Office Action dated Feb. 8, 2014 for the related Chinese Application No. 201180023685.6.
Search Report dated Jul. 4, 2014 for the related European Application No. 11780685.1.
Office Action dated Apr. 7, 2015 for the related U.S. Appl. No. 13/697,441.
Office Action dated Apr. 3, 2015 for the related Chinese Application No. 201280047170.4.
Search Report dated Apr. 16, 2015 for the corresponding European Application No. 12849153.7.
Search Report dated Apr. 16, 2015 for the related European Application No. 12843355.4.
Office Action dated Apr. 16, 2015 for the related Chinese Application No. 201280047171.9.
Office Action dated Apr. 28, 2015 for the related U.S. Appl. No. 14/352,184.
European Search Report dated Jun. 5, 2015 for the corresponding European Application No. 12847293.3.
Notice of Allowance dated Oct. 29, 2015 for the corresponding Chinese Application No. 201280049749.4 (English translation of Search Report attached).
U.S. Office Action dated Nov. 16, 2015 for the related U.S. Appl. No. 13/697,441.
Office Action dated May 13, 2016 for the related U.S. Appl. No. 14/119,025.
Office Action dated Aug. 5, 2016 for the related U.S. Appl. No. 13/697,441.
Supplemental Office Action dated Aug. 10, 2016 for the related U.S. Appl. No. 13/697,441.
*ASM Speciality Handbook-Copper and its alloys*, ISBN: 0-87170-726-8, Aug. 2001, pp. 15.
E.G. West, *Copper and its alloys*, ISBN: 0-85312-505-8, 1982, pp. 129.
Summons to attend oral proceedings dated Nov. 4, 2016 for the related European Patent Application No. 12843355.4.
Summons to attend oral proceedings dated Nov. 4, 2016 for the corresponding European Patent Application No. 12849153.7.
Notice of Allowance dated Feb. 22, 2017 for the corresponding Korean Patent Application No. 20-2014-7009375.
Notice of Allowance dated Feb. 22, 2017 for the corresponding Korean Patent Application No. 10-2014-7009375 (Previously filed on Apr. 24, 2017).
Office Action dated Apr. 28, 2017 for the related U.S. Appl. No. 14/119,025.
Office Action dated Mar. 7, 2017 for the related U.S. Appl. No. 14/291,335.
Office Action dated Mar. 8, 2017 for the related U.S. Appl. No. 13/695,666.

* cited by examiner

COPPER ALLOY AND COPPER ALLOY FORMING MATERIAL

CROSS-REFERENCE TO RELATED PATENT APPLICATIONS

This application is a U.S. National Phase application under 35 U.S.C. § 371 of International Patent Application No. PCT/JP2012/078688, filed Nov. 6, 2012, and claims the benefit of Japanese Patent Application No. 2011-248731, filed on Nov. 14, 2011, all of which are incorporated by reference in their entirety herein. The International application was published in Japanese on May 23, 2013 as International Publication No. WO/2013/073412 under PCT Article 21(2).

FIELD OF THE INVENTION

The present invention relates to a copper alloy which is used in, for example, mechanical components, electric components, articles for daily use, building materials, and the like, and a copper alloy forming material (copper alloy plastic working material, plastically-worked copper alloy material) that is shaped by plastically working a copper material composed of a copper alloy.

BACKGROUND OF THE INVENTION

In the related art, copper alloy plastic working materials have been used as materials of mechanical components, electric components, articles for daily use, building material, and the like. The copper alloy plastic working material is shaped by subjecting an ingot to plastic working such as rolling, wire drawing, extrusion, groove rolling, forging, and pressing.

Particularly, from the viewpoint of manufacturing efficiency, elongated objects such as a bar, a wire, a pipe, a plate, a strip, and a band of a copper alloy have been used as the material of the mechanical components, the electric components, the articles for daily use, the building material, and the like.

The bar has been used as a material of, for example, a socket, a bush, a bolt, a nut, an axle, a cam, a shaft, a spindle, a valve, an engine component, an electrode for resistance welding, and the like.

The wire has been used as a material of, for example, a contact, a resistor, an interconnection for robots, an interconnection for vehicles, a trolley wire, a pin, a spring, a welding rod, and the like.

The pipe has been used as a material of, for example, a water pipe, a gas pipe, a heat exchanger, a heat pipe, a break pipe, a building material, and the like.

The plate and the strip have been used as a material of, for example, a switch, a relay, a connector, a lead frame, a roof shingle, a gasket, a gear wheel, a spring, a printing plate, a gasket, a radiator, a diaphragm, a coin, and the like.

The band has been used as a material of, for example, an interconnector for a solar cell, a magnet wire, and the like.

Here, as the elongated objects (copper alloy plastic working material) such as the bar, the wire, the pipe, the plate, the strip, and the band, copper alloys having various compositions have been used according to respective uses.

For example, as a copper alloy that is used in an electronic apparatus, an electric apparatus, and the like, a Cu—Mg alloy described in Non-Patent Document 1, a Cu—Mg—Zn—B alloy described in Patent Document 1, and the like have been developed.

In this Cu—Mg-based alloy, as can be seen from a Cu—Mg-system phase diagram shown in FIG. 1, in the case where the Mg content is in a range of 3.3% by atom or more, a solution treatment and a precipitation treatment are performed to allow an intermetallic compound composed of Cu and Mg to precipitate. That is, the Cu—Mg-based alloy can have a relatively high electrical conductivity and strength due to precipitation hardening.

In addition, as a copper alloy plastic working material that is used in a trolley wire, a Cu—Mg alloy rough wire described in Patent Document 2 is suggested. In the Cu—Mg alloy, the Mg content is in a range of 0.01% by mass to 0.70% by mass. As can be seen from the Cu—Mg-system phase diagram shown in FIG. 1, the Mg content is smaller than a solid solution limit, and thus the Cu—Mg alloy described in Patent Document 2 is a solid-solution-hardening type copper alloy in which Mg is solid-solubilized in a copper matrix phase.

Here, in the Cu—Mg-based alloy described in Non-Patent Document 1 and Patent Document 1, a lot of coarse intermetallic compounds containing Cu and Mg as main components are distributed in the matrix phase. Therefore, the intermetallic compounds serve as the starting points of cracking during bending working, and thus cracking tends to occur. Accordingly, there is a problem in that it is difficult to shape a product with a complicated shape.

In addition, in the Cu—Mg-based alloy described in Patent Document 2, Mg is solid-solubilized in a copper matrix phase. Therefore, there is no problem in formability, but strength may be deficient depending on a use.

PRIOR ART DOCUMENTS

Patent Documents

Patent Document 1: Japanese Unexamined Patent Application, First Publication No. S07-018354

Patent Document 2: Japanese Unexamined Patent Application, First Publication No. 2010-188362

Non-Patent Document

Non-Patent Document 1: Hori, Shigenori and two co-researchers, "Intergranular (Grain Boundary) Precipitation in Cu—Mg alloy", Journal of the Japan Copper and Brass Research Association, Vol. 19 (1980), p. 115 to 124

Problems to be Solved by the Invention

The invention was made in consideration of the above-described circumstances, and an object thereof is to provide a copper alloy having high strength and excellent formability, and a copper alloy plastic working material composed of the copper alloy.

SUMMARY OF THE INVENTION

Means for Solving the Problems

In order to solve the problems, the present inventors have made a thorough investigation, and as a result, they obtained the following finding.

A work-hardening type copper alloy prepared by solutionizing a Cu—Mg alloy and rapidly cooling the resultant solutionized Cu—Mg alloy is composed of a Cu—Mg solid solution alloy supersaturated with Mg. The work-hardening type copper alloy has high strength and excellent formability. In addition, it is possible to improve tensile strength of the copper alloy by reducing the oxygen content.

The invention has been made on the basis of the above-described finding.

According to a first aspect of the invention, there is provided a copper alloy containing Mg at a content of 3.3% by atom to 6.9% by atom, with the balance being substantially composed of Cu and unavoidable impurities. An oxygen content is in a range of 500 ppm by atom or less.

When a Mg content is set to X % by atom, an electrical conductivity σ (% IACS) satisfies the following Expression (1).

$$\sigma \leq \{1.7241/(-0.0347 \times X^2 + 0.6569 \times X + 1.7)\} \times 100 \quad (1)$$

According to a second aspect of the invention, there is provided a copper alloy containing Mg at a content of 3.3% by atom to 6.9% by atom, with the balance substantially being Cu and unavoidable impurities. An oxygen content is in a range of 500 ppm by atom or less.

When being observed by a scanning electron microscope, an average number of intermetallic compounds, which have grain sizes of 0.1 μm or more and which contain Cu and Mg as main components, is in a range of 1 piece/$\mu m^2$ or less.

According to a third aspect of the invention, there is provided a copper alloy containing Mg at a content of 3.3% by atom to 6.9% by atom, with the balance substantially being Cu and unavoidable impurities. An oxygen content is in a range of 500 ppm by atom or less.

When a Mg content is set to X % by atom, an electrical conductivity σ (% IACS) satisfies the following Expression (1).

$$\sigma \leq \{1.7241/(-0.0347 \times X^2 + 0.6569 \times X + 1.7)\} \times 100 \quad (1)$$

When being observed by a scanning electron microscope, the average number of intermetallic compounds, which have grain sizes of 0.1 μm or more and which contain Cu and Mg as main components, is in a range of 1 piece/$\mu m^2$ or less.

According to a fourth aspect of the invention, there is provided a copper alloy containing Mg at a content of 3.3% by atom to 6.9% by atom, and at least one or more selected from a group consisting of Al, Ni, Si, Mn, Li, Ti, Fe, Co, Cr, and Zr at a total content of 0.01% by atom to 3.0% by atom, with the balance substantially being Cu and unavoidable impurities. An oxygen content is in a range of 500 ppm by atom or less.

When being observed by a scanning electron microscope, the average number of intermetallic compounds, which have grain sizes of 0.1 μm or more and which contain Cu and Mg as main components, is in a range of 1 piece/$\mu m^2$ or less.

In the above-described copper alloys according to the first and third aspects, as shown in a phase diagram of FIG. 1, Mg is contained at a content in a range of 3.3% by atom to 6.9% by atom which is equal to or greater than a solid solution limit, and when the Mg content is set to X % by atom, the electrical conductivity σ (% IACS) satisfies the above-described Expression (1). Accordingly, the copper alloy is composed of a Cu—Mg solid solution alloy supersaturated with Mg.

In addition, in the copper alloys according to the second to fourth aspects, Mg is contained at a content in a range of 3.3% by atom to 6.9% by atom which is equal to or greater than a solid solution limit, and when being observed by a scanning electron microscope, the average number of intermetallic compounds, which have grain sizes of 0.1 μm or more and which contain Cu and Mg as main components, is in a range of 1 piece/$\mu m^2$ or less. Accordingly, precipitation of the intermetallic compounds is suppressed, and thus the copper alloy is composed of a Cu—Mg solid solution alloy supersaturated with Mg.

In addition, the average number of the intermetallic compounds, which have grain sizes of 0.1 μm or more and which contain Cu and Mg as main components, is calculated by performing observation of 10 viewing fields by using a field emission scanning electron microscope at a 50,000-fold magnification and a viewing field of approximately 4.8 $\mu m^2$.

In addition, a grain size of the intermetallic compound, which contains Cu and Mg as main components, is set to an average value of the major axis and the minor axis of the intermetallic compound. In addition, the major axis is the length of the longest straight line in a grain under a condition of not coming into contact with a grain boundary midway, and the minor axis is the length of the longest straight line under a condition of not coming into contact with the grain boundary midway in a direction perpendicular to the major axis.

In the copper alloy composed of the Cu—Mg solid solution alloy supersaturated with Mg, coarse intermetallic compounds mainly containing Cu and Mg, which are the start points of cracks, are not largely dispersed in the matrix, and thus formability is greatly improved.

In addition, the copper alloy is supersaturated with Mg, and thus it is possible to greatly improve the strength by work-hardening.

In addition, in the copper alloys according to the first to fourth aspects of the invention, the oxygen content is in a range of 500 ppm by atom or less. Accordingly, a generation amount of Mg oxides is suppressed to be small, and thus it is possible to greatly improve tensile strength. In addition, occurrence of disconnection or cracking that is caused by the Mg oxides serving as starting points may be suppressed during working, and thus it is possible to greatly improve formability.

In addition, it is preferable that the oxygen content be set to be in a range of 50 ppm by atom or less to reliably obtain this operational effect, and more preferably in a range of 5 ppm by atom or less.

Further, in the copper alloy according to the first to fourth aspects of the invention, in the case of containing at least one or more selected from a group consisting of Al, Ni, Si, Mn, Li, Ti, Fe, Co, Cr, and Zr at a total content of 0.01% by atom to 3.0% by atom, it is possible to greatly improve the mechanical strength due to the operational effect of these elements.

A copper alloy plastic working material according to an aspect of the invention is shaped by plastically working a copper material composed of the above-described copper alloy. In addition, in this specification, the plastically-worked material represents a copper alloy to which plastic working is performed during several manufacturing processes.

The copper alloy plastic working material according to the aspect is composed of the Cu—Mg solid solution alloy supersaturated with Mg as described above, and thus the copper alloy plastic working material has high strength and excellent formability.

It is preferable that the copper alloy plastic working material according to the aspect of the invention be shaped according to a manufacturing method including: a melting and casting process of manufacturing a copper material having an alloy composition of the copper alloy according to the first to fourth aspects of the invention; a heating process of heating the copper material to a temperature of 400° C. to 900° C.; a rapid-cooling process of cooling the heated copper material to a temperature of 200° C. or lower at a cooling rate of 200° C./min or more; and a plastic working process of plastically working the copper material which is rapidly cooled.

In this case, the copper material having an alloy composition of the copper alloy according to the first to fourth aspects of the invention is manufactured by melting and casting. Then solutionizing of Mg can be performed by the heating process of heating the copper material to a temperature of 400° C. to 900° C. Here, in the case where the heating temperature is lower than 400° C., the solutionizing becomes incomplete, and thus there is a concern that the intermetallic compounds containing Cu and Mg as main components may remain at a large amount in the matrix phase. On the other hand, in the case where the heating temperature exceeds 900° C., a part of the copper material becomes a liquid phase, and thus there is a concern that a structure or a surface state may be non-uniform. Accordingly, the heating temperature is set to be in a range of 400° C. to 900° C. In addition, it is preferable that the heating temperature in the heating process be set to be in a range of 500° C. to 800° C. to reliably obtain the operational effect.

In addition, the rapid-cooling process of cooling the heated copper material to a temperature of 200° C. or lower at a cooling rate of 200° C./min or more is provided, and thus it is possible to suppress precipitation of the intermetallic compounds containing Cu and Mg as main components during the cooling process. Accordingly, it is possible to make the copper alloy plastic working material be composed of the Cu—Mg solid solution alloy supersaturated with Mg.

Further, the working process of subjecting the copper material (Cu—Mg solid solution alloy supersaturated with Mg), which is rapidly cooled, to plastic working is provided, and thus it is possible to realize improvement in strength due to work-hardening. Here, a working method is not particularly limited. For example, in the case where the final shape is a plate or a strip shape, rolling may be employed. In the case where the final shape is a wire or a bar shape, wire drawing, extrusion, and groove rolling may be employed. In the case where the final shape is a bulk shape, forging and pressing may be employed. A working temperature is not particularly limited, but it is preferable that the working temperature be set to be in a range of −200° C. to 200° C. at which cold working or hot working is performed in order for precipitation not to occur. A working rate is appropriately selected to approach the final shape. However, in the case of considering work-hardening, it is preferable that the working rate be set to be in a range of 20% or more, and more preferably in a range of 30% or more.

In addition, it is preferable that the copper alloy plastic working material according to the aspect of the invention be an elongated object having a shape selected from a bar shape, a wire shape, a pipe shape, a plate shape, a strip shape, and a band shape.

In this case, it is possible to manufacture a copper alloy plastic working material having high strength and excellent formability with high efficiency.

Effects of the Invention

According to the aspects of the invention, it is possible to provide a copper alloy having high strength and excellent formability, and a copper alloy plastic working material composed of the copper alloy.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

Figure 1:
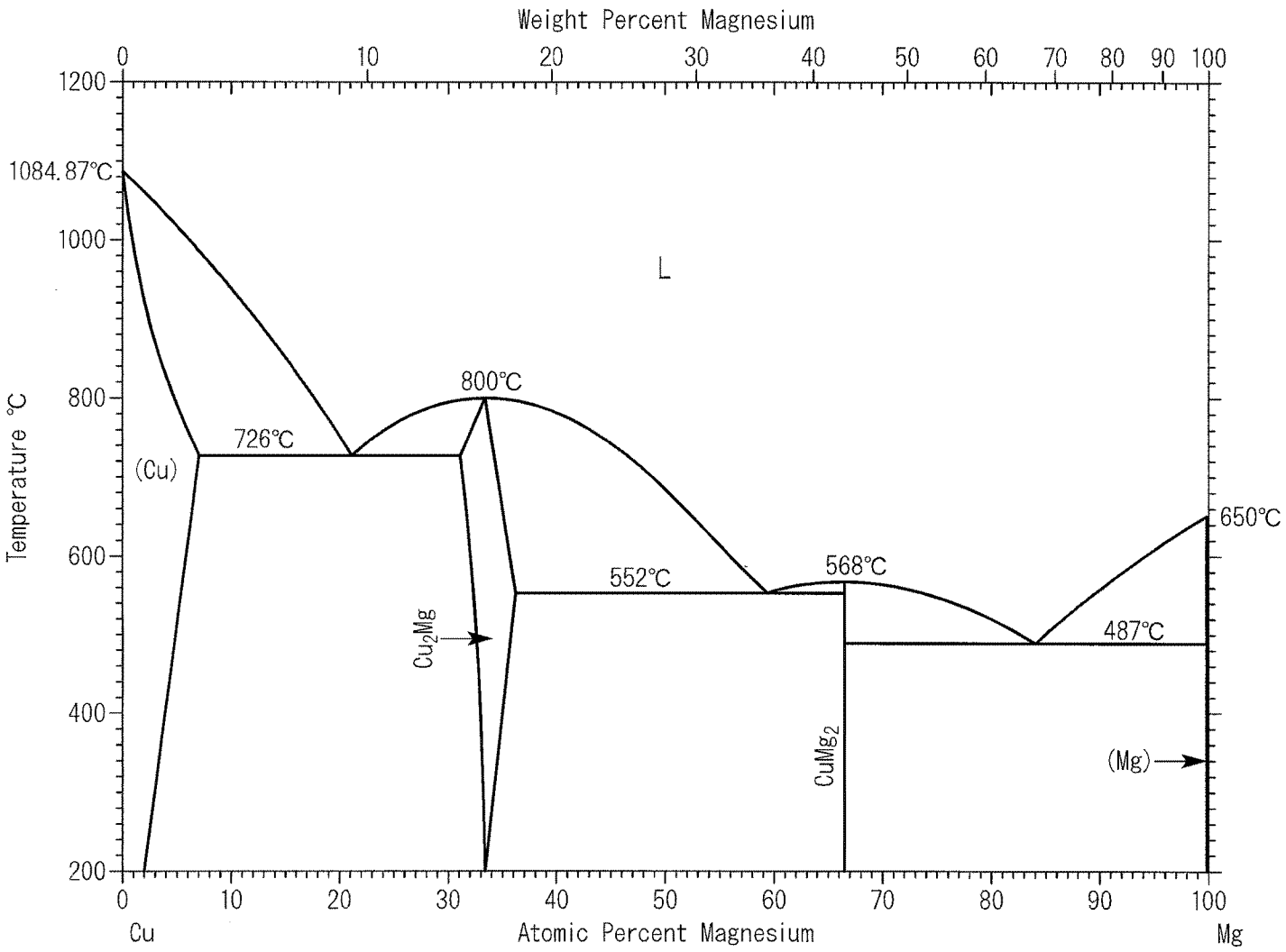
FIG. 1 is a Cu—Mg-system phase diagram.

DETAILED DESCRIPTION OF THE INVENTION (First Embodiment)

Hereinafter, a copper alloy and a copper alloy plastic working material of a first embodiment of the invention will be described. In addition, the copper alloy plastic working material is shaped by plastically working a copper material composed of a copper alloy.

In a component composition of the copper alloy of the first embodiment, Mg is contained at a content in a range of 3.3% by atom to 6.9% by atom, the balance is substantially composed of Cu and unavoidable impurities, and the oxygen content is in a range of 500 ppm by atom or less. That is, the copper alloy and the copper alloy plastic working material of this embodiment are binary alloys of Cu and Mg.

In addition, when the Mg content is set to X % by atom, an electrical conductivity a (% IACS) satisfies the following Expression (1).

$$\sigma \leq \{1.7241/(-0.0347 \times X^2 + 0.6569 \times X + 1.7)\} \times 100 \quad (1)$$

In addition, when being observed by a scanning electron microscope, the average number of intermetallic compounds, which have grain sizes of 0.1 μm or more and which contain Cu and Mg as main components, is in a range of 1 piece/$\mu m^2$ or less.

(Composition)

Mg is an element having an operational effect of improving strength and raising a recrystallization temperature without greatly lowering an electrical conductivity. In addition, when Mg is solid-solubilized in a matrix phase, excellent bending formability can be obtained.

Here, in the case where the Mg content is less than 3.3% by atom, the operational effect may not be obtained. On the other hand, in the case where the Mg content exceeds 6.9% by atom, when performing a heat treatment for solutionizing, an intermetallic compound containing Cu and Mg as main components is apt to remain. Therefore, there is a concern that cracking may occur during the subsequent processing and the like.

From this reason, the Mg content is set to be in a range of 3.3% by atom to 6.9% by atom.

Further, in the case where the Mg content is too small, strength is not improved sufficiently. In addition, since Mg is an active element, in the case where an excessive amount of Mg is added, there is a concern that the alloy may include the Mg oxides that are generated by the reaction with oxygen during melting and casting. Accordingly, the Mg content is preferably set to be in a range of 3.7% by atom to 6.3% by atom.

In addition, oxygen is an element which reacts with Mg that is an active metal as described and generates a large amount of Mg oxides. In the case where the Mg oxides are mixed in the copper alloy plastic working material, tensile strength greatly decreases. In addition, the Mg oxides serve as starting points of disconnection or cracking during working, and thus there is a concern that formability greatly deteriorates.

Therefore, in this embodiment, the oxygen content is limited to be in a range of 500 ppm by atom or less. When the oxygen content is limited in this manner, improvement in tensile strength and improvement in formability may be realized.

In addition, it is preferable that the oxygen content be set to be in a range of 50 ppm by atom or less so as to reliably obtain the above-described operational effect, and more preferably in a range of 5 ppm by atom or less. In addition, the lower limit of the oxygen content is 0.01 ppm by atom from the viewpoint of the manufacturing cost.

In addition, examples of the unavoidable impurities include Sn, Zn, Fe, Co, Al, Ag, Mn, B, P, Ca, Sr, Ba, Sc, Y, rare-earth elements, Zr, Hf, V, Nb, Ta, Cr, Mo, W, Re, Ru, Os, Se, Te, Rh, Ir, Pd, Pt, Au, Cd, Ga, In, Li, Si, Ge, As, Sb, Ti, Tl, Pb, Bi, S, C, Ni, Be, N, H, Hg, and the like. A total content of these unavoidable impurities is preferably in a range of 0.3% by mass or less.

Particularly, the Sn content is preferably in a range of less than 0.1% by mass, and the Zn content is preferably in a range of less than 0.01% by mass. In the case where the Sn content is in a range of 0.1% by mass or more, precipitation of the intermetallic compounds containing Cu and Mg as main components tends to occur. In addition, in the case where the Zn content is in a range of 0.01% by mass or more, fumes are generated during the melting and casting process, and these fumes adhere to members of a furnace or a mold. According to this adhesion, surface quality of an ingot deteriorates, and resistance to stress corrosion cracking deteriorates.

(Electrical Conductivity σ)

In the binary alloy of Cu and Mg, when the Mg content is set to X % by atom, in the case where the electrical conductivity σ satisfies the following Expression (1), the intermetallic compounds containing Cu and Mg as main components are hardly present.

$$\sigma \leq \{1.7241/(-0.0347 \times X^2 + 0.6569 \times X + 1.7)\} \times 100 \quad (1)$$

That is, in the case where the electrical conductivity σ exceeds the value of the right-hand side of Expression (1), a large amount of intermetallic compounds containing Cu and Mg as main components are present, and the size of the intermetallic compound is relatively large. Therefore, bending formability greatly deteriorates. Accordingly, manufacturing conditions are adjusted in order for the electrical conductivity σ to satisfy the above-described Expression (1).

In addition, it is preferable that the electrical conductivity σ (% IACS) satisfy the following Expression (2) so as to reliably obtain the above-described operational effect.

$$\sigma \leq \{1.7241/(-0.0300 \times X^2 + 0.6763 - X + 1.7)\} \times 100 \quad (2)$$

In this case, the amount of the intermetallic compounds containing Cu and Mg as main components is relatively small, and thus the bending formability is further improved.

It is preferable that the electrical conductivity σ (% IACS) satisfy the following Expression (3) so as to further reliably obtain the above-described operational effect.

$$\sigma \leq \{1.7241/(-0.0292 \times X^2 + 0.6797 \times X + 1.7)\} \times 100 \quad (3)$$

In this case, the amount of the intermetallic compounds containing Cu and Mg as main components is relatively small, and thus the bending formability is further improved.

(Structure)

From results of observation using scanning electron microscope, in the copper alloy and the copper alloy plastic working material of this embodiment, the average number of intermetallic compounds, which have grain sizes of 0.1 μm or more and which contain Cu and Mg as main components, is in a range of 1 piece/$\mu m^2$ or less. That is, the intermetallic compounds containing Cu and Mg as main components hardly precipitate, and Mg is solid-solubilized in a matrix phase.

Here, in the case where the solutionizing is incomplete, or the intermetallic compounds containing Cu and Mg as main components precipitate after the solutionizing, a large amount of intermetallic compounds having large sizes are present. In this case, the intermetallic compounds serve as starting points of cracking, and thus cracking may occur during working or the bending formability may greatly deteriorate. In addition, the upper limit of the grain size of the intermetallic compound that is generated in the copper alloy of the invention is preferably 5 μm, and more preferably 1 μm.

From results obtained by observing a structure, in the case where the number of intermetallic compounds in the alloy, which have grain sizes of 0.1 μm or more and which contain Cu and Mg as main components, is in a range of 1 piece/$\mu m^2$ or less, that is, in the case where the intermetallic compound containing Cu and Mg as main components are not present or are present in a small amount, satisfactory bending formability can be obtained.

Further, it is more preferable that the number of the intermetallic compounds in the alloy, which have grain sizes of 0.05 μm or more and which contain Cu and Mg as main components, is in a range of 1 piece/$\mu m^2$ or less so as to reliably obtain the above-described operational effect.

In addition, the average number of the intermetallic compounds containing Cu and Mg as main components may be obtained by observing 10 viewing fields by using a field emission scanning electron microscope at a 50,000-fold magnification and a viewing field of approximately 4.8 $\mu m^2$, and calculating the average value.

In addition, a grain size of the intermetallic compound containing Cu and Mg as main components is set to an average value of the major axis and the minor axis of the intermetallic compound. In addition, the major axis is the length of the longest straight line in a grain under a condition of not coming into contact with a grain boundary midway, and the minor axis is the length of the longest straight line under a condition of not coming into contact with the grain boundary midway in a direction perpendicular to the major axis.

Here, the intermetallic compound containing Cu and Mg as main components has a crystal structure expressed by a chemical formula of $MgCu_2$, a prototype of $MgCu_2$, a Pearson symbol of cF24, and a space group number of Fd-3m.

Figure 2:
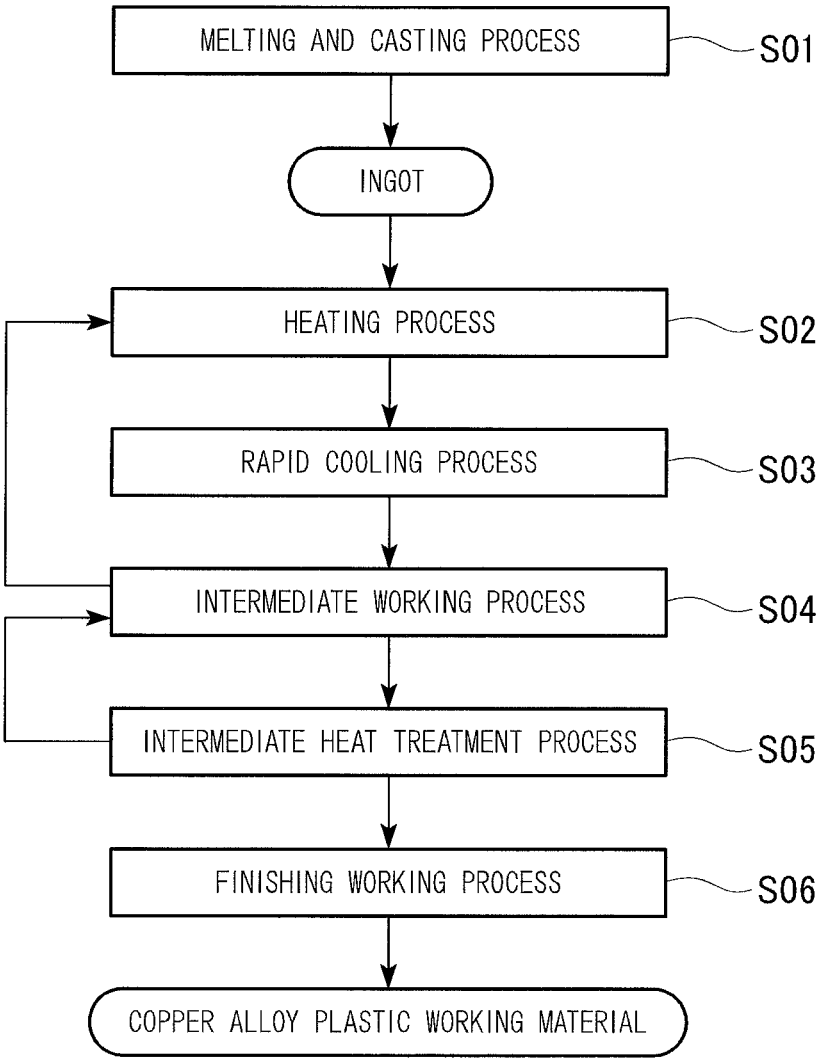
FIG. 2 is a flowchart of a method of manufacturing a copper alloy and a copper alloy plastic working material of present embodiments.

For example, the copper alloy and the copper alloy plastic working material of the first embodiment, which have these characteristics, are manufactured by a manufacturing method illustrated in a flowchart of FIG. 2.

(Melting and Casting Process S01)

First, a copper raw material is melted to obtain molten copper, and then the above-described elements are added to the obtained molten copper to perform component adjustment; and thereby, a molten copper alloy is produced. In addition, a single element of Mg, a Cu—Mg master alloy, and the like may be used for the addition of Mg. In addition, raw materials containing Mg may be melted in combination with the copper raw materials. In addition, a recycle material or a scrap material of the copper alloy may be used.

Here, it is preferable that the molten copper be copper having purity of 99.9999% by mass, that is, so-called 6N Cu. In addition, in the melting process, it is preferable to use a vacuum furnace or an atmosphere furnace in an inert gas atmosphere or a reducing atmosphere to suppress oxidation of Mg.

Then, the molten copper alloy in which component adjustment is performed is poured in a casting mold to produce an ingot. In addition, when considering mass productivity, a continuous casting method or a half-continuous casting method is preferably applied.

(Heating Process S02)

Next, a heating treatment is performed for homogenization and solutionizing of the obtained ingot. Mg segregates and is concentrated during solidification, and thus the intermetallic compounds containing Cu and Mg as main components are generated. The intermetallic compounds containing Cu and Mg as main components, and the like are present in the interior of the ingot. Therefore, a heating treatment of heating the ingot to a temperature of 400° C. to 900° C. is performed so as to remove or reduce the segregation and the intermetallic compounds. According to the heat treatment, in the ingot, Mg is homogeneously diffused, or Mg is solid-solubilized in a matrix phase. In addition, the heating process S02 is preferably performed in a non-oxidizing atmosphere or a reducing atmosphere.

Here, in the case where the heating temperature is lower than 400° C., the solutionizing becomes incomplete, and thus there is a concern that a large amount of intermetallic compounds containing Cu and Mg as main components remain in the matrix phase. On the other hand, in the case where the heating temperature exceeds 900° C., a part of the copper material becomes a liquid phase, and thus there is a concern that a structure or a surface state may be non-uniform. Accordingly, the heat temperature is set to be in a range of 400° C. to 900° C. The heating temperature is more preferably in a range of 500° C. to 850° C., and still more preferably in a range of 520° C. to 800° C.

(Rapid Cooling Process S03)

Then, the copper material that is heated to a temperature of 400° C. to 900° C. in the heating process S02 is cooled down to a temperature of 200° C. or lower at a cooling rate of 200° C./min or more. According to this rapid cooling process S03, precipitation of Mg, which is solid-solubilized in the matrix phase, as the intermetallic compounds containing Cu and Mg as main components is suppressed. Accordingly, when being observed by a scanning electron microscope, the average number of the intermetallic compounds, which have grain sizes of 0.1 μm or more and which contain Cu and Mg as main components, may be set to be in a range of 1 piece/$\mu m^2$ or less. That is, it is possible to make the copper material be composed of a Cu—Mg solid solution alloy supersaturated with Mg.

In addition, for efficiency of a rough working and homogenization of a structure, hot working may be performed after the above-described heating process S02, and the above-described rapid cooling process S03 may be performed after the hot working. In this case, a working method (hot working method) is not particularly limited. For example, in the case where the final shape is a plate or a strip shape, rolling may be employed. In the case where the final shape is a wire or a bar shape, wire drawing, extrusion, and groove rolling may be employed. In the case where the final shape is a bulk shape, forging and pressing may be employed.

(Intermediate Working Process S04)

The copper material after being subjected to the heating process S02 and the rapid cooling process S03 is cut as necessary. In addition, surface grinding is performed as necessary to remove an oxide film generated in the heating process S02, the rapid cooling process S03, and the like. In addition, plastic working is performed to have a predetermined shape.

In addition, temperature conditions in the intermediate working process S04 are not particularly limited. However, it is preferable that the working temperature be set to be in a range of −200° C. to 200° C. at which cold working or hot working is performed. In addition, a working rate is appropriately selected to approach the final shape. However, it is preferable that the working rate be set to be in a range of 20% or more to reduce the number of times of the intermediate heat treatment process S05 until obtaining the final shape. In addition, the working rate is more preferably set to be in a range of 30% or more.

A working method is not particularly limited. However, in the case where the final shape is a plate or a strip shape, rolling may be employed. In the case where the final shape is a wire or a bar shape, extrusion and groove rolling may be employed. In the case where the final shape is a bulk shape, forging and pressing may be employed. Further, the process S02 to S04 may be repeated for complete solutionizing.

(Intermediate Heat Treatment Process S05)

After the intermediate working process S04, a heat treatment is performed for the purpose of thorough solutionizing and softening to recrystallize the structure or to improve formability.

The heat treatment method is not particularly limited, but the heat treatment is performed in a non-oxidizing atmosphere or a reducing atmosphere at a temperature of 400° C. to 900° C. The heat treatment temperature is more preferably in a temperature of 500° C. to 850° C., and still more preferably in a temperature of 520° C. to 800° C.

Here, in the intermediate heat treatment process S05, the copper material, which is heated to a temperature of 400° C. to 900° C., is cooled down to a temperature of 200° C. or lower at a cooling rate of 200° C./min or more.

According to this rapid cooling, precipitation of Mg, which is solid-solubilized in the matrix phase, as the intermetallic compounds containing Cu and Mg as main components is suppressed. Accordingly, when being observed by a scanning electron microscope, the average number of the intermetallic compounds, which have grain sizes of 0.1 μm or more and which contain Cu and Mg as main components, may be set to be in a range of 1 piece/$\mu m^2$ or less. That is, it is possible to make the copper material be composed of the Cu—Mg solid solution alloy supersaturated with Mg.

In addition, the intermediate working process S04 and the intermediate heat treatment process S05 may be repetitively performed.

(Finishing Working Process S06)

The copper material after being subjected to the intermediate heat treatment process S05 is subjected to finishing working to obtain a predetermined shape. In addition, temperature conditions in this finishing working process S06 are not particularly limited, but the finishing working process S06 is preferably performed at room temperature. In addition, a working rate of the plastic working (finishing working) is appropriately selected to approach the final shape. However, it is preferable that the working rate be set to be in a range of 20% or more to improve the strength by work-hardening. In addition, the working rate is more preferably set to be in a range of 30% or more to obtain further improvement in the strength. A plastic working method (finishing working method) is not particularly limited. However, in the case where the final shape is a plate or a strip shape, rolling may be employed. In the case where the final shape is a wire or a bar shape, extrusion and groove rolling may be employed. In the case where the final shape is a bulk shape, forging and pressing may be employed. In addition, cutting such as turning process, milling, and drilling may be performed as necessary.

In this manner, the copper alloy plastic working material of this embodiment is obtained. In addition, the copper alloy plastic working material of this embodiment is an elongated object having a shape selected from a bar shape, a wire shape, a pipe shape, a plate shape, a strip shape, and a band shape.

According to the copper alloy and the copper alloy plastic working material of this embodiment, Mg is contained at a content in a range of 3.3% by atom to 6.9% by atom, and the balance is substantially composed of Cu and unavoidable impurities, and the oxygen content is in a range of 500 ppm by atom or less. In addition, when the Mg content is set to X % by atom, an electrical conductivity σ (% IACS) satisfies the following Expression (1).

$$\sigma \leq \{1.7241/(-0.0347 \times X^2 + 0.6569 \times X + 1.7)\} \times 100 \quad (1)$$

In addition, when being observed by a scanning electron microscope, the average number of intermetallic compounds, which have grain sizes of 0.1 μm or more and which contain Cu and Mg as main components, is in a range of 1 piece/$\mu m^2$ or less.

That is, the copper alloy and the copper alloy plastic working material of this embodiment are Cu—Mg solid solution alloys supersaturated with Mg.

In the copper alloy composed of the Cu—Mg solid solution alloy supersaturated with Mg, coarse intermetallic compounds mainly containing Cu and Mg, which are the start points of cracks, are not largely dispersed in the matrix, and thus bending formability is improved.

Further, in this embodiment, the oxygen content is in a range of 500 ppm by atom or less, and thus a generation amount of Mg oxides is suppressed to be small. Accordingly, it is possible to greatly improve tensile strength. In addition, occurrence of disconnection or cracking that is caused by the Mg oxides serving as starting points may be suppressed during working, and thus it is possible to greatly improve formability.

Further, according to this embodiment, the copper alloy is supersaturated with Mg. Accordingly, strength is greatly improved by work-hardening, and thus it is possible to provide a copper alloy plastic working material having relatively high strength.

In addition, the copper alloy plastic working material of this embodiment is shaped according to the manufacturing method including the following processes S02 to S04.

In the heating process S02, an ingot or a worked material is heated to a temperature of 400° C. to 900° C. In the rapid cooling process S03, the ingot or the worked material, which is heated, is cooled down to 200° C. or lower at a cooling rate of 200° C./min. In the intermediate working process S04, the rapidly cooled material is subjected to plastic working.

Accordingly, it is possible to obtain a copper alloy plastic working material composed of a Cu—Mg solid solution alloy supersaturated with Mg.

That is, according to the heating process 02 of heating the ingot or the worked material to a temperature of 400° C. to 900° C., the solutionizing of Mg can be performed.

In addition, the rapid cooling process S03 is provided in which the ingot or the worked material, which has been heated to 400° C. to 900° C. in the heating process S02, is cooled to a temperature of 200° C. or lower at a cooling rate of 200° C./min or more. Accordingly, it is possible to suppress precipitation of the intermetallic compounds containing Cu and Mg as main components during the cooling process. Accordingly, it is possible to make the ingot or the worked material after being rapidly cooled be composed of the Cu—Mg solid solution alloy supersaturated with Mg.

Further, the intermediate working process S04 is provided in which the rapidly cooled material (Cu—Mg solid solution alloy supersaturated with Mg) is subjected to plastic working, and thus it is possible to easily obtain a shape close to the final shape.

In addition, after the intermediate working process S04, the intermediate heat treatment process S05 is provided for the purpose of thorough solutionizing and softening to recrystallize the structure or to improve formability. Accordingly, it is possible to realize improvement in characteristics and formability.

In addition, in the intermediate heat treatment process S05, the plastically-worked material, which has been heated to a temperature of 400° C. to 900° C., is rapidly cooled to a temperature of 200° C. or lower at a cooling rate of 200° C./min or more. Accordingly, it is possible to suppress precipitation of the intermetallic compounds containing Cu and Mg as main components during the cooling process. Accordingly, it is possible to make the plastically-worked material after rapid cooling be composed of the Cu—Mg solid solution alloy supersaturated with Mg.

In addition, the finishing working process S06 of subjecting the plastically-worked material after the intermediate heat treatment process S05 to plastic working is provided to obtain a predetermined shape. Accordingly, it is possible to realize improvement in strength due to stain hardening.

(Second Embodiment)

Next, a copper alloy and a copper alloy plastic working material of a second embodiment of the invention will be described.

In a component composition of the copper alloy of the second embodiment, Mg is contained at a content in a range of 3.3% by atom to 6.9% by atom, at least one or more selected from a group consisting of Al, Ni, Si, Mn, Li, Ti, Fe, Co, Cr, and Zr are additionally contained at a total content in a range of 0.01% by atom to 3.0% by atom, the balance is substantially composed of Cu and unavoidable impurities, and the oxygen content is in a range of 500 ppm by atom or less.

In addition, in the copper alloy of the second embodiment, when being observed by a scanning electron microscope, the average number of intermetallic compounds, which have grain sizes of 0.1 μm or more and which contain Cu and Mg as main components, is in a range of 1 piece/$\mu m^2$ or less.

(Composition)

As described in the first embodiment, Mg is an element having an operational effect of improving strength and raising a recrystallization temperature without greatly lowering an electrical conductivity. In addition, when Mg is solid-solubilized in a matrix phase, excellent bending formability can be obtained.

Accordingly, the Mg content is set to be in a range of 3.3% by atom to 6.9% by atom. In addition, it is preferable that the Mg content be set to be in a range of 3.7% by atom to 6.3% by atom to reliably obtain the above-described operational effect.

In addition, as is the case with the first embodiment, in this embodiment, the oxygen content is limited to be in a range of 500 ppm by atom. According to this, improvement in tensile strength and improvement in formability may be realized. In addition, the oxygen content is more preferably set to be in a range of 50 ppm by atom or less, and still more preferably in a range of 10 ppm by atom or less.

In addition, the lower limit of the oxygen content is 0.01 ppm by atom from the viewpoint of the manufacturing cost.

In addition, in the copper alloy of the second embodiment, at least one or more selected from a group consisting of Al, Ni, Si, Mn, Li, Ti, Fe, Co, Cr, and Zr are contained.

Al, Ni, Si, Mn, Li, Ti, Fe, Co, Cr, and Zr are elements having an operational effect of further improving the strength of the copper alloy composed of a Cu—Mg solid solution alloy supersaturated with Mg.

Here, in the case where the total content of at least one or more selected from a group consisting of Al, Ni, Si, Mn, Li, Ti, Fe, Co, Cr, and Zr is less than 0.1% by atom, the operational effect is not obtained. On the other hand, in the case where the total content of at least one or more selected from a group consisting of Al, Ni, Si, Mn, Li, Ti, Fe, Co, Cr, and Zr exceeds 3.0% by atom, the electrical conductivity greatly decreases, and thus this range is not preferable.

From this reason, the total content of at least one or more selected from a group consisting of Al, Ni, Si, Mn, Li, Ti, Fe, Co, Cr, and Zr is set to be in a range of 0.1% by atom to 3.0% by atom.

In addition, examples of the unavoidable impurities, Sn, Zn, Ag, B, P, Ca, Sr, Ba, Sc, Y, rare-earth elements, Hf, V, Nb, Ta, Mo, W, Re, Ru, Os, Se, Te, Rh, Ir, Pd, Pt, Au, Cd, Ga, In, Ge, As, Sb, Tl, Pb, Bi, S, C, Be, N, H, Hg, and the like. A total content of these unavoidable impurities is preferably in a range of 0.3% by mass or less.

Particularly, the Sn content is preferably in a range of less than 0.1% by mass, and the Zn content is preferably in a range of less than 0.10% by mass. In the case where the Sn content is in a range of 0.1% by mass or more, precipitation of the intermetallic compounds containing Cu and Mg as main components tends to occur. In addition, in the case where the Zn content is in a range of 0.01% by mass or more, fumes are generated during the melting and casting process, and these fumes adhere to members of a furnace or a mold. According to this adhesion, surface quality of an ingot deteriorates, and resistance to stress corrosion cracking deteriorates.

(Structure)

From results of observation using a scanning electron microscope, in the copper alloy of this embodiment, the average number of intermetallic compounds, which have grain sizes of 0.1 μm or more and which contain Cu and Mg as main components, is in a range of 1 piece/$\mu m^2$ or less. That is, the intermetallic compounds containing Cu and Mg as main components hardly precipitate, and Mg is solid-solubilized in a matrix phase.

Here, the intermetallic compound containing Cu and Mg as main components has a crystal structure expressed by a chemical formula of $MgCu_2$, a prototype of $MgCu_2$, a Pearson symbol of cF24, and a space group number of Fd-3m.

In addition, the average number of the intermetallic compound containing Cu and Mg as main components may be obtained by performing observation of 10 viewing fields by using a field emission scanning electron microscope at a 50,000-fold magnification and a viewing field of approximately 4.8 $\mu m^2$, and calculating the average value.

In addition, a grain size of the intermetallic compound containing Cu and Mg as main components is set to an average value of the major axis and the minor axis of the intermetallic compounds. In addition, the major axis is the length of the longest straight line in a grain under a condition of not coming into contact with a grain boundary midway, and the minor axis is the length of the longest straight line under a condition of not coming into contact with the grain boundary midway in a direction perpendicular to the major axis.

The copper alloy and the copper alloy plastic working material of the second embodiment are manufactured in the same method as the first embodiment.

According to the copper alloy and the copper alloy plastic working material of the second embodiment, which have these characteristics, when being observed with a scanning electron microscope, the average number of intermetallic compounds, which have grain sizes of 0.1 μm or more and which contain Cu and Mg as main components, is in a range of 1 piece/$\mu m^2$ or less. Further, the oxygen content is in a range of 500 ppm or less, and thus as is the case with the first embodiment, the formability is greatly improved.

In addition, in this embodiment, at least one or more selected from a group consisting of Al, Ni, Si, Mn, Li, Ti, Fe, Co, Cr, and Zr are contained at a total content in a range of 0.01% by atom to 3.0% by atom. Accordingly, it is possible to greatly improve the mechanical strength due to the operational effect of these elements.

Hereinbefore, the copper alloy and the copper alloy plastic working material of the embodiments have been described. However, the invention is not limited thereto, and may be appropriately modified in a range not departing from the features described herein.

For example, in the embodiments, the copper alloys for electronic devices, which satisfy both of a condition of "the number of intermetallic compounds, which have grain sizes of 0.1 μm or more and which contain Cu and Mg as main components, in the alloy is in a range of 1 piece/$\mu m^2$ or less" and a condition of relating to "electrical conductivity σ", are illustrated. However, the copper alloy for electronic devices may satisfy any one of the conditions.

In addition, in the above-described embodiments, an example of the method of manufacturing the copper alloy plastic working material has been illustrated. However, the manufacturing method is not limited to the embodiments, and the copper alloy plastic working material may be manufactured by appropriately selecting manufacturing methods in the related art.

EXAMPLES

Hereinafter, results of a confirmation test performed to confirm the effects of the embodiments will be described.

A copper raw material was put in a crucible, and the copper raw material was subjected to high frequency melting in an atmosphere furnace in a $N_2$ gas atmosphere or a $N_2$—$O_2$ gas atmosphere; and thereby, a molten copper was obtained. Various kinds of elements were added to the obtained molten copper to prepare component compositions shown in Table 1, and each of these component compositions was poured into a carbon mold to produce an ingot. In addition, the size of the ingot was set to have dimensions of a thickness (approximately 50 mm)×a width (approximately 50 mm)×a length (approximately 300 mm). In addition, additives having the oxygen contents of 50 ppm by mass or less were used as various additive elements.

In addition, as a copper raw material, either one of 6N copper having purity of 99.9999% by mass or tough pitch copper (CT1100) containing a predetermined amount of oxygen was used, or a mixture obtained by approximately mixing both of these was used. According to this, the oxygen content was adjusted.

In addition, the oxygen content in the alloy was measured by an inert gas fusion-infrared absorption method. The measured oxygen content is shown in Table 1. Here, the oxygen content also includes an amount of oxygen of oxides that are contained in the alloy.

The obtained ingot was subjected to a heating process of performing heating for 4 hours in an Ar gas atmosphere under temperature conditions described in Tables 2 and 3, and then water quenching was performed.

The ingot after being subjected to the heat treatment was cut, and surface grinding was performed to remove an oxide film. Then, cold groove rolling was performed at room temperature to adjust a cross-sectional shape from 50 mm square to 10 mm square. The ingot was subjected to an intermediate working as described above; and thereby, an intermediate worked material (square bar material) was obtained.

Then, the obtained intermediate worked material (square bar material) was subjected to an intermediate heat treatment in a salt bath under the temperature conditions described in Tables 2 and 3. Then, water quenching was performed.

Next, drawing (wire drawing) was performed as finishing working; and thereby, a finished material (wire material) having a diameter of 0.5 mm was produced.

(Evaluation of Formability)

The evaluation of formability was made according to whether or not disconnection was present during the above-described drawing (wire drawing). The case where wire drawing could be performed until the final shape was obtained was evaluated as A (Good). The case where disconnection frequently occurred during the wire drawing, and thus the wire drawing could not be performed until the final shape was obtained was evaluated as B (Bad).

Mechanical characteristics and an electrical conductivity were measured by using the above-described intermediate worked material (square bar material) and the finished material (wire material).

(Mechanical Characteristics)

With respect to the intermediate worked material (square bar material), a No. 2 test specimen defined in JIS Z 2201 was collected, and tensile strength was measured by a tensile test method of JIS Z 2241.

With respect to the final material (wire material), a No. 9 test specimen defined in JIS Z 2201 was collected, and the tensile strength was measured by the tensile test method of JIS Z2241.

(Electrical Conductivity)

With respect to the intermediate worked material (square bar material), an electrical conductivity was calculated by JIS H 0505 (methods of measuring a volume resistivity and an electrical conductivity of non-ferrous materials).

With respect to the finished material (wire material), electrical resistivity was measured in a measurement length of 1 m by a four-terminal method according to JIS C 3001. In addition, a volume was calculated from a wire diameter and the measurement length of the test specimen. In addition, volume resistivity was obtained from the electrical resistivity and the volume that were measured; and thereby, the electrical conductivity was calculated.

(Structure Observation)

The cross-sectional center of the intermediate worked material (square bar material) was subjected to mirror polishing and ion etching. Observation was performed in a viewing field at a 10,000-fold magnification (approximately 120 $\mu m^2$/viewing field) by using FE-SEM (field emission scanning electron microscope) so as to confirm a precipitation state of the intermetallic compound containing Cu and Mg as main components.

Next, a viewing field at a 10,000-fold magnification (approximately 120 $\mu m^2$/viewing field) in which the precipitation state of the intermetallic compounds was not special was selected, and at that region, continuous 10 viewing fields (approximately 4.8 $\mu m^2$/viewing field) at a 50,000-fold magnification were photographed so as to investigate the density (piece/$\mu m^2$) of the intermetallic compounds containing Cu and Mg as main components. The grain size of the intermetallic compound was set to an average value of the major axis and the minor axis of the intermetallic compounds. In addition, the major axis is the length of the longest straight line in a grain under a condition of not coming into contact with a grain boundary midway, and the minor axis is the length of the longest straight line under a condition of not coming into contact with the grain boundary midway in a direction perpendicular to the major axis. In addition, the density (average number) of the intermetallic compounds which had grain sizes of 0.1 μm or more and which contained Cu and Mg as main components, and the density (average number) of the intermetallic compounds which had grain sizes of 0.05 μm or more and which contained Cu and Mg as main components were obtained.

Component compositions, manufacturing conditions, and evaluation results are shown in Tables 1 to 3.

TABLE 1

| | | Component Compositions | | | |
|---|---|---|---|---|---|
| | | Mg(% by atom) | Others (% by atom) | O (ppm by atom) | Cu |
| Examples of Invention | 1 | 3.4 | — | 0.5 | Balance |
| | 2 | 3.8 | — | 1.8 | Balance |
| | 3 | 4.0 | — | 0.2 | Balance |
| | 4 | 4.0 | — | 0.2 | Balance |
| | 5 | 4.0 | — | 0.2 | Balance |
| | 6 | 4.2 | — | 4.3 | Balance |
| | 7 | 4.5 | — | 0.2 | Balance |
| | 8 | 5.1 | — | 1.2 | Balance |
| | 9 | 5.4 | — | 0.3 | Balance |
| | 10 | 6.0 | — | 0.1 | Balance |
| | 11 | 6.5 | — | 0.5 | Balance |
| | 12 | 4.0 | — | 40 | Balance |
| | 13 | 4.1 | — | 400 | Balance |
| | 14 | 3.4 | Si: 0.20, Mn: 0.13, Cr: 0.10 | 0.5 | Balance |

TABLE 1-continued

| | | Component Compositions | | | |
|---|---|---|---|---|---|
| | | Mg(% by atom) | Others (% by atom) | O (ppm by atom) | Cu |
| | 15 | 3.9 | Ni: 1.50, Li: 0.12 | 1.7 | Balance |
| | 16 | 4.2 | Ti: 0.23 | 0.1 | Balance |
| | 17 | 4.6 | Mn: 1.00, Fe: 0.10, Zr: 0.03 | 4.4 | Balance |
| | 18 | 5.0 | Ni: 2.00, Co: 0.10 | 0.1 | Balance |
| | 19 | 5.3 | Li: 0.12, Fe: 0.30 | 1.2 | Balance |
| | 20 | 5.9 | Mn: 0.60, Co: 0.20 | 0.4 | Balance |
| | 21 | 6.4 | Al: 2.00, Ni: 0.80 | 0.0 | Balance |
| Conventional | 1 | 1.9 | — | 0.4 | Balance |
| Examples | 2 | 5.1 | — | 3.8 | Balance |
| Comparative | 1 | 10.6 | — | 1.5 | Balance |
| Examples | 2 | 4.0 | — | 900 | Balance |
| | 3 | 5.3 | Al: 2.10, Si: 2.80 | 0.2 | Balance |
| | 4 | 6.0 | Mn: 3.10, Li: 0.10 | 1.1 | Balance |

TABLE 2

| | | Temperature | | | Electrical | Precipitates (piece/μm$^2$) | | | Tensile | |
|---|---|---|---|---|---|---|---|---|---|---|
| | | Temperature in heating process | in intermediate heat treatment process | Tensile strength of intermediate material (MPa) | conductivity of intermediate material (% IACS) | Grain sizes of 0.05 μm or more | Grain sizes of 0.1 μm or more | Formability | strength of finished material (MPa) | Electrical conductivity of finished material (% IACS) |
| Examples of Invention | 1 | 715° C. | 550° C. | 302 | 45.1% | 0 | 0 | A | 994 | 42.8% |
| | 2 | 715° C. | 550° C. | 307 | 42.2% | 0 | 0 | A | 1022 | 39.7% |
| | 3 | 715° C. | 515° C. | 303 | 44.2% | 0 | 0.4 | A | 1020 | 41.8% |
| | 4 | 715° C. | 525° C. | 305 | 43.7% | 0 | 0 | A | 1031 | 41.2% |
| | 5 | 715° C. | 550° C. | 311 | 41.8% | 0 | 0 | A | 1036 | 39.5% |
| | 6 | 715° C. | 550° C. | 313 | 41.1% | 0 | 0 | A | 1053 | 38.9% |
| | 7 | 715° C. | 625° C. | 316 | 37.3% | 0 | 0 | A | 1070 | 35.1% |
| | 8 | 715° C. | 650° C. | 321 | 35.1% | 0 | 0 | A | 1103 | 33.2% |
| | 9 | 715° C. | 650° C. | 327 | 34.3% | 0 | 0 | A | 1113 | 32.3% |
| | 10 | 715° C. | 700° C. | 335 | 33.0% | 0 | 0 | A | 1130 | 31.3% |
| | 11 | 715° C. | 700° C. | 343 | 32.3% | 0 | 0 | A | 1145 | 30.6% |
| | 12 | 715° C. | 550° C. | 305 | 42.1% | 0 | 0 | A | 1021 | 39.8% |
| | 13 | 715° C. | 550° C. | 301 | 42.3% | 0 | 0 | A | 962 | 39.8% |
| | 14 | 715° C. | 550° C. | 305 | 31.4% | 0 | 0 | A | 1002 | 29.6% |

TABLE 3

| | | Temperature | | | Electrical | Precipitates (piece/μm$^2$) | | | Tensile | |
|---|---|---|---|---|---|---|---|---|---|---|
| | | Temperature in heating process | in intermediate heat treatment process | Tensile strength of intermediate material (MPa) | conductivity of intermediate material (% IACS) | Grain sizes of 0.05 μm or more | Grain sizes of 0.1 μm or more | Formability | strength of finished material (MPa | Electrical conductivity of finished material (% IACS) |
| Examples of Invention | 15 | 715° C. | 550° C. | 319 | 27.1% | 0 | 0 | A | 1060 | 25.6% |
| | 16 | 715° C. | 550° C. | 322 | 24.4% | 0 | 0 | A | 1080 | 23.1% |
| | 17 | 715° C. | 550° C. | 320 | 19.1% | 0 | 0 | A | 1077 | 18.1% |
| | 18 | 715° C. | 625° C. | 333 | 20.9% | 0 | 0 | A | 1142 | 19.8% |
| | 19 | 715° C. | 650° C. | 330 | 20.9% | 0 | 0 | A | 1125 | 19.8% |
| | 20 | 715° C. | 650° C. | 341 | 19.9% | 0 | 0 | A | 1148 | 18.8% |
| | 21 | 715° C. | 700° C. | 387 | 18.5% | 0 | 0 | A | 1277 | 17.5% |
| Conventional | 1 | 715° C. | 625° C. | 276 | 58.5% | 0 | 0 | A | 843 | 55.1% |
| Examples | 2 | 715° C. | 500° C. | 283 | 46.1% | 10 | 23 | B | — | — |
| Comparative | 1 | 715° C. | — | — | — | — | — | — | — | — |
| Examples | 2 | 715° C. | 550° C. | 280 | 42.0% | 0 | 0 | B | — | — |
| | 3 | 715° C. | 550° C. | 398 | 8.9% | 0 | 0 | A | 1315 | 8.4% |
| | 4 | 715° C. | 550° C. | 350 | 11.0% | 0 | 0 | A | 1159 | 10.4% |

In Conventional Example 1, the Mg content was lower than the range of the embodiments. All of the tensile strength of the intermediate material (square bar material) and the tensile strength of the finished material (wire material) were low.

In Conventional Example 2, a lot of intermetallic compounds containing Cu and Mg as main components precipitated. The tensile strength of the intermediate material (square bar material) was low. In addition, disconnection frequently occurred during drawing (wire drawing), and thus preparation of the finished material (wire material) was stopped.

In Comparative Example 1, the Mg content was larger than the range of the embodiments. Large cracking starting from a coarse intermetallic compound occurred during the intermediate working (cold groove rolling). Therefore, the subsequent preparation of the finished material (wire material) was stopped.

In Comparative Example 2, the oxygen content was larger than the range of the embodiments. The tensile strength of the intermediate material (square bar material) was low. In addition, disconnection frequently occurred during drawing (wire drawing), and thus preparation of the finished material (wire material) was stopped. It is assumed that this situation was affected by Mg oxides.

With regard to Comparative Examples 3 and 4, the total contents of one or more selected from a group consisting of Al, Ni, Si, Mn, Li, Ti, Fe, Co, Cr, and Zr exceeded 3.0% by atom. It was confirmed that the electrical conductivity greatly decreased.

In contrast, in Examples 1 to 21 of the invention, it was confirmed that satisfactory formability, satisfactory tensile strengths of the intermediate material and the finished material, and a satisfactory electrical conductivity were secured.

Figure 3:
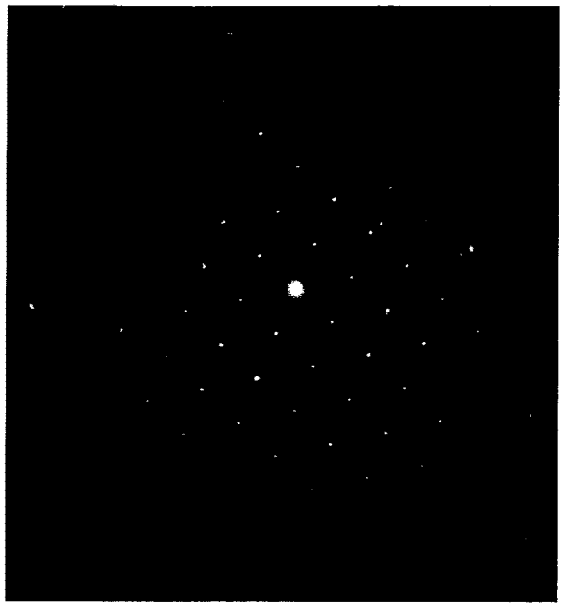
FIG. 3 is a diagram illustrating a result (electron diffraction pattern) obtained by observing a precipitate in Conventional Example 2.

FIG. 3 illustrates an electron diffraction pattern of the precipitate which was confirmed in Conventional Example 2. This electron diffraction pattern coincides with the electron beam diffraction pattern that can be obtained by allowing electron beams to be incident to $MgCu_2$, which has a crystal structure expressed by a Pearson symbol of cF24, a space group number of Fd-3m (227), and lattice constants a=b=c=0.7034 nm, in the following orientation. Accordingly, the precipitate corresponds to "intermetallic compound containing Cu and Mg as main components" in the embodiments.

[1 $\bar{1}$0] [Mathematical Formula 1]

In addition, in Examples 1 to 21 of the invention, the above-described intermetallic compounds containing Cu and Mg as main components are not observed, and the copper alloys are composed of a Cu—Mg solid solution alloy supersaturated with Mg.

As described above, it was confirmed that it is possible to provide a copper alloy having high strength and excellent formability, and a copper alloy plastic working material composed of the copper alloy according to Examples of the invention.

INDUSTRIAL APPLICABILITY

The copper alloy and the copper alloy plastic working material of the embodiments have high strength and excellent formability. Accordingly, the copper alloy and the copper alloy plastic working material of the embodiments are suitably applicable to materials of components having a complicated shape or components in which high strength is demanded, among mechanical components, electric components, articles for daily use, and building materials.

The invention claimed is:

1. A copper alloy, consisting of:

Mg, oxygen and a balance of Cu and unavoidable impurities, wherein a Mg content is in a range of 3.3% by atom to 6.9% by atom, an oxygen content is in a range of 0.01 ppm by atom to 500 ppm by atom, the copper alloy has a measured value of an electrical conductivity σ (% IACS) that does not exceed a calculated value of an electrical conductivity in % IACS expressed by a formulaic expression $\{1.7241/(-0.0347\times X^2+0.6569\times X+1.7)\}\times 100$, wherein X is the Mg content in % by atom in the copper alloy, and the copper alloy is a Cu—Mg solid solution alloy supersaturated with Mg.

2. The copper alloy according to claim 1, wherein the oxygen content is in a range of 0.01 ppm by atom to 50 ppm by atom.

3. A copper alloy plastic working material which is shaped by plastically working a copper material composed of the copper alloy according to claim 1.

4. The copper alloy plastic working material according to claim 3, wherein the copper alloy plastic working material is an elongated object having a shape selected from a bar shape, a wire shape, a pipe shape, a plate shape, a strip shape, and a band shape.

5. A copper alloy plastic working material which is shaped by plastically working a copper material composed of the copper alloy according to claim 1, wherein the copper alloy plastic working material is shaped according to a manufacturing method including:

a melting and casting process of manufacturing the copper material;

a heating process of heating the copper material to a temperature of 400° C. to 900° C.;

a rapid-cooling process of cooling the heated copper material to a temperature of 200° C. or lower at a cooling rate of 200° C./min or more; and a plastic working process of plastically working the copper material which is rapidly cooled.

6. The copper alloy plastic working material according to claim 5, wherein the copper alloy plastic working material is an elongated object having a shape selected from a bar shape, a wire shape, a pipe shape, a plate shape, a strip shape, and a band shape.

7. A copper alloy, consisting of:

Mg, oxygen, and a balance of Cu and unavoidable impurities, wherein a Mg content is in a range of 3.3% by atom to 4.2% by atom, an oxygen content is in a range of 0.01 ppm by atom to 500 ppm by atom, the copper alloy has a measured value of an electrical conductivity of the copper alloy σ (% IACS) that does not exceed a calculated value of an electrical conductivity in % IACS expressed by a formulaic expression $\{1.7241/(-0.0347\times X^2+0.6569\times X+1.7)\}\times 100$, wherein X is the Mg content in % by atom in the copper alloy, and the copper alloy is a Cu—Mg solid solution alloy supersaturated with Mg.

8. A copper alloy, consisting of:

Mg, oxygen, and a balance of Cu and unavoidable impurities, wherein a Mg content is in a range of more than 4.2% by atom to 5.9% by atom, an oxygen content is in a range of 0.01 ppm by atom to 500 ppm by atom, the copper alloy has a measured value of an electrical conductivity σ (% IACS) that does not exceed a calculated value of an electrical conductivity in % IACS expressed by a formulaic expression $\{1.7241/(-0.0347\times X^2+0.6569\times X+1.7)\}\times 100$, wherein X is the Mg content in % by atom in the copper alloy, and the copper alloy is a Cu—Mg solid solution alloy supersaturated with Mg.

9. A copper alloy, consisting of:

Mg, oxygen, and a balance of Cu and unavoidable impurities, wherein a Mg content is in a range of more than 5.9% by atom to 6.9% by atom, an oxygen content is in a range of 0.01 ppm by atom to 500 ppm by atom, the copper alloy has a measured value of an electrical conductivity of the copper alloy σ (% IACS) that does not exceed a calculated value of an electrical conductivity in % IACS expressed by a formulaic expression $\{1.7241/(-0.0347\times X^2+0.6569\times X+1.7)\}\times 100$, wherein X is the Mg content in % by atom in the copper alloy, and the copper alloy is a Cu—Mg solid solution alloy supersaturated with Mg.

10. A copper alloy, consisting of:

Mg, oxygen and a balance of Cu and unavoidable impurities, wherein a Mg content is in a range of 3.3% by atom to 6.9% by atom, an oxygen content is in a range of 500 ppm by atom or less, the copper alloy has a measured value of an electrical conductivity σ (% IACS) does not exceed a calculated value of an electrical conductivity in % IACS expressed by a formulaic expression $\{1.7241/(-0.0347\times X^2+0.6569\times X+1.7)\}\times 100$, wherein X is the Mg content in % by atom in the copper alloy, when being observed by a scanning electron microscope, an average number of intermetallic compounds, which have grain sizes of 0.1 μm or more and which contain Cu and Mg as main components, is in a range of 1 piece/$\mu m^2$ or less, and the copper alloy is a Cu—Mg solid solution alloy supersaturated with Mg.

11. The copper alloy according to claim 10, wherein the oxygen content is in a range of 0.01 ppm by atom to 50 ppm by atom.

12. A copper alloy plastic working material which is shaped by plastically working a copper material composed of the copper alloy according to claim 10.

13. A copper alloy plastic working material which is shaped by plastically working a copper material composed of the copper alloy according to claim 10, wherein the copper alloy plastic working material is shaped according to a manufacturing method including:

a melting and casting process of manufacturing the copper material;

a heating process of heating the copper material to a temperature of 400° C. to 900° C.;

a rapid-cooling process of cooling the heated copper material to a temperature of 200° C. or lower at a cooling rate of 200° C./min or more; and a plastic working process of plastically working the copper material which is rapidly cooled.

14. A copper alloy, consisting of:

Mg, oxygen and a balance of Cu and unavoidable impurities, wherein a Mg content is in a range of 3.3% by atom to 6.9% by atom, an oxygen content is in a range of 500 ppm by atom or less, when being observed by a scanning electron microscope, an average number of intermetallic compounds, which have grain sizes of 0.1 μm or more and which contain Cu and Mg as main components, is in a range of 1 piece/$\mu m^2$ or less, and the copper alloy is a Cu—Mg solid solution alloy supersaturated with Mg.

15. The copper alloy according to claim 14, wherein the oxygen content is in a range of 0.01 ppm by atom to 50 ppm by atom.

16. A copper alloy plastic working material which is shaped by plastically working a copper material composed of the copper alloy according to claim 14.

17. A copper alloy plastic working material which is shaped by plastically working a copper material composed of the copper alloy according to claim 14, wherein the copper alloy plastic working material is shaped according to a manufacturing method including:

a melting and casting process of manufacturing the copper material;

a heating process of heating the copper material to a temperature of 400° C. to 900° C.;

a rapid-cooling process of cooling the heated copper material to a temperature of 200° C. or lower at a cooling rate of 200° C./min or more; and a plastic working process of plastically working the copper material which is rapidly cooled.

18. A copper alloy, consisting of:

Mg at a content of 3.3% by atom to 6.9% by atom;

at least one or more elements selected from a group consisting of Al, Ni, Si, Mn, Li, Ti, Fe, Co, Cr, and Zr at a total content of 0.01% by atom to 3.0% by atom;

oxygen at a content of 500 ppm by atom or less; and a balance of Cu and unavoidable impurities, wherein, when being observed by a scanning electron microscope, an average number of intermetallic compounds, which have grain sizes of 0.1 μm or more and which contain Cu and Mg as main components, is in a range of 1 piece/$\mu m^2$ or less, and the copper alloy is a Cu—Mg solid solution alloy supersaturated with Mg.

19. The copper alloy according to claim 18, wherein the oxygen content is in a range of 0.01 ppm by atom to 50 ppm by atom.

20. A copper alloy plastic working material which is shaped by plastically working a copper material composed of the copper alloy according to claim 18.

21. A copper alloy plastic working material which is shaped by plastically working a copper material composed of the copper alloy according to claim 18, wherein the copper alloy plastic working material is shaped according to a manufacturing method including:

a melting and casting process of manufacturing the copper material;

a heating process of heating the copper material to a temperature of 400° C. to 900° C.;

a rapid-cooling process of cooling the heated copper material to a temperature of 200° C. or lower at a cooling rate of 200° C./min or more; and a plastic working process of plastically working the copper material which is rapidly cooled.

* * * * *